United States Patent [19]

Jackson

[11] Patent Number: 4,561,707

[45] Date of Patent: Dec. 31, 1985

[54] CURRENT-SHEET INDUCTOR NETWORK AND PULSE-FORMING SYSTEMS

[75] Inventor: Robert V. Jackson, Los Angeles, Calif.

[73] Assignee: McCulloch Corporation, Los Angeles, Calif.

[21] Appl. No.: 479,742

[22] Filed: Mar. 28, 1983

[51] Int. Cl.[4] ..... F23Q 3/00

[52] U.S. Cl. ..... 315/209 CD; 315/209 SC; 361/256; 361/257; 361/270

[58] Field of Search ..... 315/209 CD, 209 SCR, 315/209 M; 361/256, 257, 308, 311, 270; 320/1; 336/181

[56] References Cited

U.S. PATENT DOCUMENTS

| | | | |
|---|---|---|---|
| 2,394,768 | 2/1946 | Harkness | 361/270 X |
| 2,521,513 | 9/1950 | Gray | 361/270 X |
| 3,262,031 | 7/1966 | Schaeffer | 361/311 |
| 3,933,139 | 1/1976 | Beeghly | 315/209 CD X |
| 4,036,201 | 7/1977 | Burson | 315/209 SC X |
| 4,353,012 | 10/1982 | Fallier, Jr. et al. | 315/209 CD X |
| 4,368,407 | 1/1983 | Wroblewski | 361/270 X |

FOREIGN PATENT DOCUMENTS

| | | |
|---|---|---|
| 574940 | 1/1946 | United Kingdom . |
| 886864 | 1/1962 | United Kingdom . |
| 1321439 | 6/1973 | United Kingdom . |
| 1410008 | 10/1975 | United Kingdom . |

*Primary Examiner*—David K. Moore
*Assistant Examiner*—Vincent DeLuca
*Attorney, Agent, or Firm*—Murray, Whisenhunt and Ferguson

[57] ABSTRACT

An electrical energy storage and transforming device and associated pulse-forming systems suitable for receiving, storing, and transforming an electrical charge to produce electrical output pulses, for example, ignition pulses for a spark-ignition internal combustion engine, includes a current sheet inductor network defined by at least two conductive current sheet inductors separated by and insulated from one another by a dielectric material to provide coupled current sheet inductors having resistive, capacitive, and inductive characteristics. When electrical energy is applied to the current sheet inductor network, and electrical charge is stored and retained as an electrostatic field between the conductive current sheets until an output pulse is desired, at which time the conductive strips of the inductively coupled current sheet inductors are substantially shunted to rapidly discharge the previously charged energy. Electron flow in each sheet during discharge reinforces to provide a consequent magnetic field. An output inductor in magnetic proximity to the so-produced magnetic field provides the desired electrical output pulse. The conductive sheets can be configured so as to have resistive, capacitive, and inductive reactance, and relative ratios thereof, that are largely independently controlled to provide selected magnetic field, transient, and pulse-forming characteristics for a desired application.

13 Claims, 8 Drawing Figures

CURRENT-SHEET INDUCTOR NETWORK AND PULSE-FORMING SYSTEMS

BACKGROUND OF THE INVENTION

The present invention relates to electrical energy storage and transforming devices and associated pulse-forming systems and, more particularly, to electrical energy storage and transforming devices that can receive and store an electrical charge and, when desired, deliver the so-stored charge to provide a desired output pulse, and, still more particularly, to systems, such as ignition systems for spark-ignition engines, utilizing such electrical energy storage and transforming devices for providing electrical output pulses.

Various devices, circuits, and systems are known for producing electrical energy pulses for diverse applications including the ignition system of spark-ignition internal combustion engines. The systems typically include a step-up transformer having inductively coupled primary and secondary windings. In such systems, electrical energy is applied to the primary winding and controlled to cause the desired output pulse across the secondary output winding. Prior systems have included switched-current systems and capacitive discharge systems. In the switched-current systems, a current flow is established through the primary winding to build a desired magnetic field and selectively interrupted in a step-wise manner by the opening of either a mechanical or semi-conductor switch to cause the desired output pulse. In the more sophisticated capacitive discharge ignition system, a capacitor in circuit with the primary winding is charged and, when an output pulse is desired, the capacitor is discharged through a triggerable switch to discharge the capacitively stored energy through the primary winding of the transformer to produce the desired output pulse. Capacitive discharge systems have many advantages in that a certain flexibility exists in most applications for the charging of the capacitor and in that the capacitor can retain its charge until an output pulse is desired. However, the capacitor is a separate physical component that is connected through conventional wiring to the primary of the pulse forming transformer; as can be appreciated, use of a physically separate capacitor in combination with the primary of the transformer adds a certain cost increment to the entire system and the need to rapidly switch a capacitively stored charge into an inductor can have a limiting effect on the upper output pulse repetition rate.

SUMMARY OF THE INVENTION

It is an object of the present invention to provide an electrical energy receiving, storing, and transforming device suitable for use in pulse-forming systems and the like that is reliable, inexpensive to produce, and simpler and more efficient than prior art devices and systems.

It is another object of the present invention to provide an electrical energy storage and transforming device for producing output pulses in which the electrical energy utilized to form the pulse is initially stored in an electrostatic field and in which the so-stored energy is utilized to produce a rapidly changing magnetic field that induces an output pulse in an inductively coupled output device.

It is another object of the present invention to provide a current sheet inductor network for storing and transforming electrical energy in which conductive current sheet inductors are inductively and capacitively coupled to one another to provide for the storage of electrical energy between the so-coupled current sheets and for discharging of the so-stored electrical energy to produce a desired transient magnetic field.

It is a further object of the present invention to provide a current sheet inductor network defined by inductively and capacitively coupled conductive current sheet inductors in which the electrical parameters including the resistive, capacitive, and inductive parameters and the ratios thereof are largely independently controllable.

It is a still further object of the present invention to provide an electric pulse-forming system that utilizes a current sheet inductor network in which electrical energy is received and stored between conductive, coupled current sheets and, when an output pulse is desired, discharged to cause the electron flow in each current sheet to produce a reinforcing magnetic field that induces a desired output pulse in an inductively coupled output inductor.

It is a still further object of the present invention to provide a spark-ignition system for an internal combustion engine that utilizes a current sheet inductor network in which electrical energy is received and stored between conductive, coupled current sheets and, when an output ignition pulse is desired, discharged to cause the electron flow in each current sheet to produce a reinforcing magnetic field that induces a desired output ignition pulse in an inductively coupled output inductor.

In accordance with these objects, and others, the present invention provides an electrical energy storage and transforming device in the form of a current sheet inductor network defined by inductively and capacitively coupled conductive current sheet inductors that accept and store an electrical energy charge as an electro-static field between the so-coupled current sheet inductors. When the so-stored energy is discharged, the electron discharge flow in each sheet produces a consequent transient magnetic field that can be inductively transferred to an output inductor coil to provide a desired electrical output pulse.

In a more specific form, the current sheet inductor network includes at least first and second conductive current sheet inductors separated by and insulated from one another by a dielectric medium so as to enable the current sheet inductor network to receive and retain an electric charge in response to electron flow caused in the sheets by connection to a power source. The conductive current sheets are configured, for example, in a coil-like configuration to provide the network with resistive, capacitive, and inductive characteristics. The network may be charged by causing an electron flow in the conductive sheets by connection to a power source and likewise discharged, for example, by shunting the conductive sheets together, so that the consequent electron flow in the so-shunted and discharging conductive sheets produces a consequent transient magnetic field which induces an electrical energy pulse into an inductive output device.

In the preferred embodiment, the current sheet inductor network is defined by interleaved and coiled elongated conductive and dielectric strips with at least one terminal lead connected to each conductive strip. An output inductor coil and core are located within the coiled conductive and dielectric strips to permit inductive energy transfer thereto. Electrical energy from a suitable power source, such as a battery or a moving magnet/pick-up coil type generator in an ignition system application, is applied to the two conductive strips to apply and store an electric charge as an electrostatic field therebetween, which charge is retained until such time that an output pulse is desired. When an output pulse is desired, a switch is triggered to shunt the conductive strips causing a transient discharge current flow which produces a rapidly changing magnetic field that, in turn, induces an electrical pulse of selected magnitude in the output inductor.

In accordance with one feature of the invention, one or both of the terminal leads connected to the elongated conductive strips may be positioned intermediate the ends of their respective strips to vary the magnetic field producing characteristics of the current sheet inductor network without affecting the capacitive characteristic to thereby change the ratio of the inductive and capacitive characteristics.

DESCRIPTION OF THE PREFERRED EMBODIMENT

Figure 1:
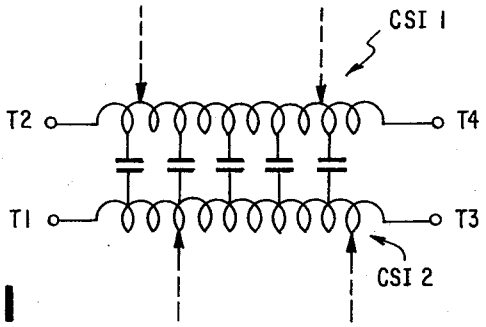
FIG. 1 is a schematic diagram of a current sheet inductor network in accordance with the present invention.

FIG. 1 is a schematic diagram illustrating, in part, the electrical characteristics of a current sheet inductor network in accordance with the present invention. As shown therein, a current sheet inductor network includes at least two conductive current sheet inductors CSI 1 and CSI 2 configured, as described more fully below, to have a coupled capacitive and inductive relationship. While not symbolically illustrated in FIG. 1, it is to be understood that the current sheet inductors each have a distributed resistance. The current sheet inductors have fixed end terminations T1 . . . 4 to provide a 4-terminal network although, as illustrated in broken-line and as discussed below, selectively positioned taps may be used. The current sheet inductor network of FIG. 1 is useful as an electrical energy storing and transforming device in which the resistive, capacitive, and inductive characteristics and the ratios thereof can be largely independently controlled to provide substantial design flexibility and a device which is particularly useful in electrical-pulse formation.

Figure 3:
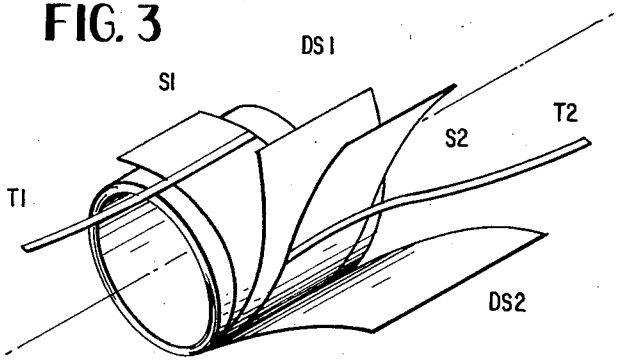
FIG. 3 is a perspective view illustrative of the assembled strips of FIG. 2 shown in an exemplary spiral wound coil configuration.
Figure 2:
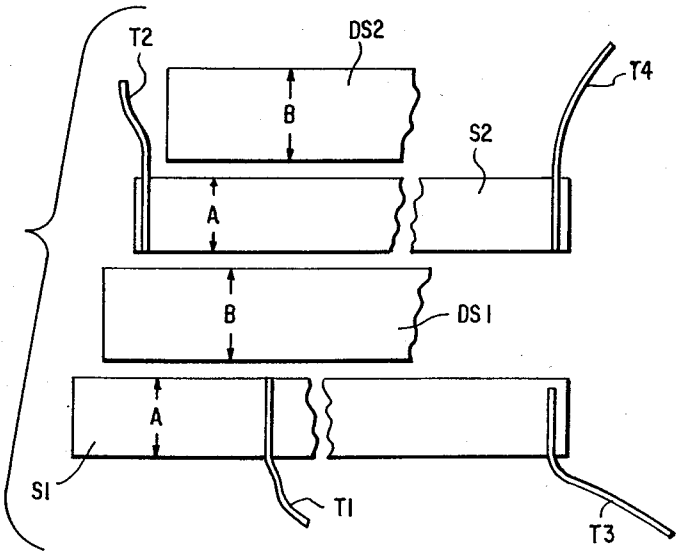
FIG. 2 is a partial flat development view of conductive and dielectric strips that form a current sheet inductor network of the type schematically illustrated in FIG. 1.

FIGS. 2 and 3 illustrate one manner of fabricating current sheet inductor network, referred to hereinafter as a "CSI network", having the characteristics described above. As shown in FIG. 2, a CSI network is preferably formed from first and second conductive foil strips S1 and S2 and interleaved strips DS1 and DS2 of an insulating dielectric material. The conductive and dielectric strips are interleaved with one another and, as shown in FIG. 3, wound to form a coil having an internal opening of selected diameter, preferably between 2 and 3 cm. The conductive strips S1 and S2 have a width dimension "A" that is preferably narrower than the width dimension "B" of the interleaved dielectric strips DS1 and DS2, and the conductive and dielectric strips are positioned relative to one another so that the conductive strips S1 and S2 will not make electrical contact with each other along their edges. Likewise, the overall length of the non-conductive dielectric strips DS1 and DS2 is longer than the length of the adjacent interleaved conductive strips S1 and S2 to thereby space and insulate the conductive strips from one another.

Termination leads T1 . . . 4 are connected, as by spot or continuous welding, to their respective conductive strips S1 and S2 prior to forming the interleaved sheets into the coil of FIG. 3. As described more fully below, the placement of one or more of the terminal leads T1 . . . 4 along the length of their respective conductive strips S1 and S2 can be varied to change the capacitive-/inductive ratio characteristic of the CSI network.

For the ignition system application described below, the conductive strips S1 and S2 can be fabricated from a conductive metal, such as aluminum or aluminum alloy of selected resistivity, having a thickness between 4 and 12 microns, a width between 12 and 32 millimeters, and a length between 5 and 7 meters. The insulating dielectric strips can be fabricated from a non-conductive material such as mylar, having a film thickness of 4 to 12 microns, a selected dielectric constant, and a width and length preferably wider and longer than the width and length of the selected conductive strips as discussed above. As can be appreciated by those skilled in the art, other materials and fabrication techniques can be used, including the deposition of a conductive metal layer onto a dielectric strip, such as by the vacuum deposition or sputtering of aluminum, to form a combined conductive/dielectric strip that can be used with one or more other strips of like construction to form the CSI network.

The resistive, capacitive, and inductive characteristics of a CSI network are determined, in part, by the materials and the physical construction of the device. The resistance is a function of the resistivity of the conductive material, the cross-sectional area and length of the conductive strips S1 and S2, and, to some extent, the operating temperature. The capacitive characteristic is determined by the confronting surface area of the conductive strips S1 and S2, the spacing between the conductive strips as determined by the thickness of the dielectric strips DS1 and DS2, and the dielectric constant of the dielectric strips. The inductive characteristic, as is known for wound current sheet inductors in general, is a function of the cross-sectional area of the current sheets, their total length, and the number of turns. As can be appreciated from a consideration of the physical structure of the disclosed CSI network, substantial mutual inductive coupling is present between the conductive sheets S1 and S2.

The resistive, capacitive, and inductive characteristics can be varied in a manner largely independent of one another by merely varying the material characteristics and physical dimensions discussed above. The inductive characteristics and the mutual inductance can be varied by relative positioning of tap terminals and controlling the direction of electron flow during charging or discharging to establish partial or full opposing or aiding field formation. As can also be appreciated, the figure of merit, Q, for both the inductive characteristics ($X_L/R_L$) and the capacitive characteristics ($X_c/R_c$) are controllable.

When direct current electrical energy is applied to the conductive strips, electron flow occurs in a time-varying manner for some period of time until the conductive strips S1 and S2 are equally and oppositely charged with the charge energy retained in an electrostatic field between the conductive sheets. During the time electron flow occurs, a consequent magnetic filed occurs and, depending upon the direction of flow in each conductive strip as determined by choice of fixed or tap terminals used, the consequent magnetic field can be full or partially aiding or opposing. The capacitive attributes of the CSI network will retain an applied charge for a time period that is a function, in part, of the resistance of the dielectric medium and any leakage paths. During discharge of the so-stored electric field, the direction of electron flow can be controlled to also produce a consequent magnetic field. Thus, shunting of the two fully charged conductive strips S1 and S2 using terminals that cause magnetic field aiding will produce a rapidly changing magnetic field, and shunting of two fully charged conductive strips S1 and S2 using terminals that cause magnetic field opposing will mitigate against the production of a magnetic field. Of course, use of selected tap terminals for shunting will produce a transient magnetic field of desired characteristics. The transient magnetic field produced during discharge of charged conductive strips can be coupled to an inductive output coil to provide electrical output pulses.

Figure 4:
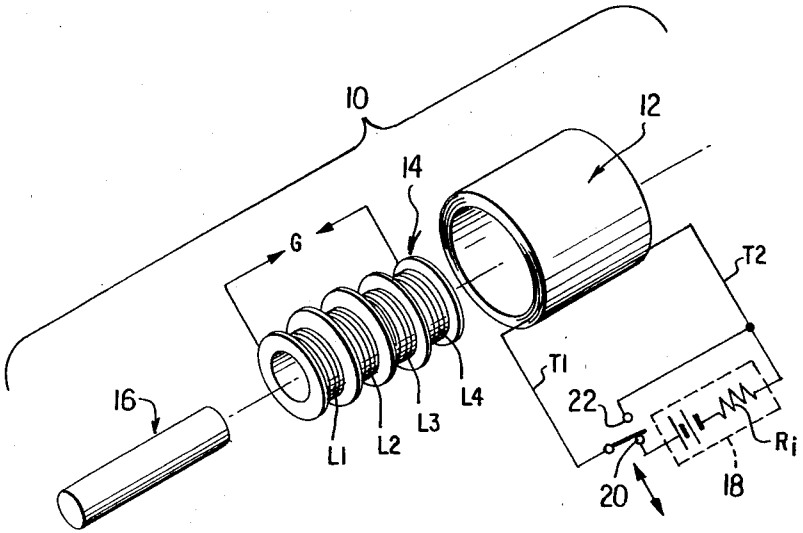
FIG. 4 is an exploded perspective view of a current sheet inductor network pulse-forming device in accordance with the present invention.
Figure 5:
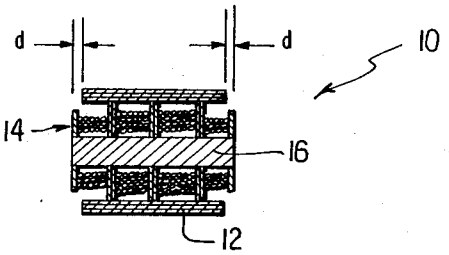
FIG. 5 is a cross-sectional view of the current sheet inductor network pulse-forming device of FIG. 4 shown in its assembled form.

A pulse-forming system utilizing the CSI network described above is shown in exploded perspective in FIG. 4 and in cross-section in FIG. 5 and is referred to therein by the reference character 10. The pulse-forming system 10 includes a CSI network 12 constructed as described above in FIGS. 1–3, and inductive output coil 14, and a core 16.

The inductive output coil 14, as shown in FIGS. 4 and 5, is preferably a Pi-wound type coil defined by a plurality of serially connected bobbin-wound subcoils $L_{1 \ldots n}$, where n=4 in the case of the preferred embodiment. The Pi-wound configuration is preferred since the voltage drop across each of the bobbin-wound subcoils $L_1 \ldots L_4$ will be equal to the total output voltage of the coil 14 divided by the number of bobbin-wound subcoils utilized. Accordingly, the voltage drop between the individual turns or turn layers of each bobbin-wound subcoil $L_n$ will be relatively less than, for example, were a single coil construction utilized. In addition, the Pi winding technique permits the varying of the number of turns of each bobbin-wound subcoil $L_n$ in the interest of both electrical and cost efficiency. As shown in the organization of the subcoils in FIG. 5, the end subcoils $L_1$ and $L_4$ have a lower number of turns than the subcoils intermediate the end coils; the lower number of turns being present where fewer lines of force are present and the greater number of turns being present where a greater number of the lines of force are concentrated.

In an ignition system application, the inductive output coil 14 is defined by four separate bobbin-wound subcoils each wound with #38 wire with 1000 turns of wire being applied to the intermediate subcoils and 700 turns of wire being applied to the end coils for a total of 3,400 turns of wire. The core 16 is fabricated from a magnetic material of selected and preferably high permeability, such as ferrite, and is positioned within the output inductor 14 to concentrate the magnetic lines of force. As shown in FIG. 5, the overall length of the inductive output coil 14 is greater than that of the CSI network 12 with the output coil extending outward from the ends of the CSI network 12 by a selected distance "d". The illustrated end-extension "d" advantageously places wire turns in the flux line path to increase electrical efficiency.

The operation of the pulse-forming system 10 can be summarized from FIG. 4. The two conductive strips S1 and S2 are connected through their respective terminations T1 and T2 to a source of DC power, such as the battery 18 through switch contact 20. Upon activation of the source power, free conduction electrons will flow so that one of the strips will have an excess of electrons (negatively charged) and the other a paucity of electrons (positively charged) with an electrostatic field developed and retained between the conductive strips to maintain the charge. The rate of charge application will be a function of the distributed reactances and conductivity of the strips S1 and S2 as well as the internal impedance $R_i$ of the power source 18. The charge applied to the pulse-forming system 10 can be removed by effecting a discharge through shunting switch contact 22. When shunted, a substantial transient current flow will initially develop with the discharge electron flow producing a preferably reinforcing magnetic field. The lines of flux of the field are concentrated by the core 16 and also cut the turns of the output inductor coil 14. Because of the nature of the transient current flow, the magnetic field will be a rapidly changing one so that a voltage pulse will be inducted into and developed across the output coil 14 terminals. This voltage pulse can be utilized by a pulse utilizing device such as the spark gap G.

Figure 6:
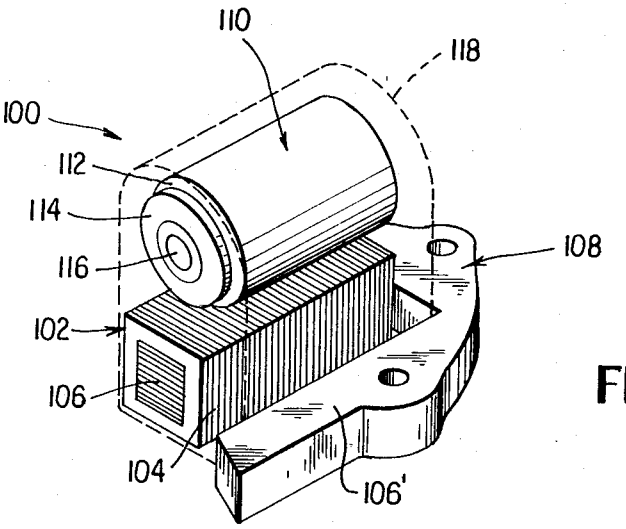
FIG. 6 is a perspective view of a magneto-type ignition system for a spark-ignition engine that utilizes the current sheet inductor network pulse-forming device of FIGS. 2–5.

A practical embodiment of the above described CSI network 10 in an electronic pulse-forming ignition system for an internal combustion engine is shown in FIG. 6 and generally referred to therein by the reference character 100. The ignition system 100 includes a charge generating and trigger coil 102 having a multi-turn winding 104 mounted on one leg 106 of a laminated, generally U-shaped, magnetic core 108; the other leg 106' of the core 108 serving to complete a below described magnetic circuit. A pulse-forming system 110 is disposed above the charge generating and trigger coil 104 as shown. The pulse-forming system 110 includes a CSI network 112, an inductive output coil 114, and a core 116 as described generally above in relation to FIGS. 1–5. The charge generating and trigger coil 102 and the CSI network 112 are interconnected by various electrical components, preferably mounted on a printed circuit board (not shown), with these components preferably encapsulated in an encapsulating material, as generally indicated at 118.

Figure 7:
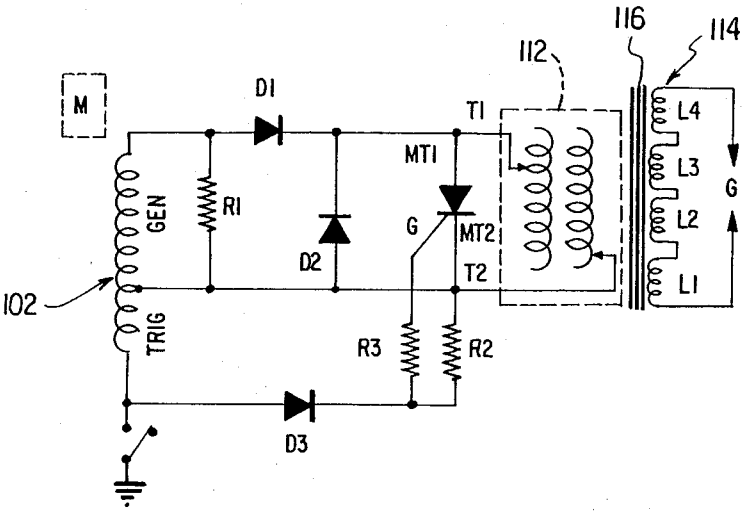
FIG. 7 is a circuit diagram of electrical components used in cooperation with the ignition system of FIG. 6.

The ignition system 100 is typically mounted adjacent the outside diameter rim portion of an internal combustion engine flywheel (not shown) which carries one or more permanent magnets past the pole faces of the laminated core 108 during each engine revolution to provide electrical energy to the ignition system through the charge generating and trigger coil 102 as explained below. The physical components of FIG. 6 and their cooperating electrical devices are interconnected as shown in the schematic diagram of FIG. 7. The CSI network 112 is represented in FIG. 7 by conventional inductor symbols adjacent to one another but not electrically connected. The output inductor coil 114 is shown as four serially connected subcoils $L_1$–$L_4$ and the magnetic core 116 is shown disposed intermediate the CSI network 112 and the output coil 114. The terminals T1 and T2 are shown as taps on each of the conductive strips to indicate that these terminals may be positioned intermediate the ends of their respective conductive strips to alter the ratio of the capacitive/inductive characteristics. The terminals are positioned so that electron flow in at least a portion of the conductive strips during discharge is in the same direction to provide magnetic field reinforcement as discussed above.

The charge generator and trigger coil 102 is shown as a tapped winding adjacent a schematically shown permanent magnet M which, as is known in the art, sweeps past the charge generator and trigger coil with each engine revolution to induce an electrical flow into the coil. A coil portion GEN effects charge generation and a smaller portion of the coil TRIG effects trigger signal generation. One end of the charge generation portion of the coil GEN is connected to terminal T1 through a PN diode D1 while the other end of the coil GEN is connected to terminal T2 of the CSI network 112. A silicon controlled rectifier SCR1, having terminals MT1, MT2, and G, and a PN diode D2 are connected across the terminals T1 and T2 while a resistor R1 is connected across the charge generating portion GEN of the coil 102. The trigger circuit includes a PN diode D3 and a resistor R2 serially connected with the terminal MT2 of the SCR1 and a resistor R3 connected between the gate terminal G and the junction between the diode D3 and the resistor R2.

Figure 8:
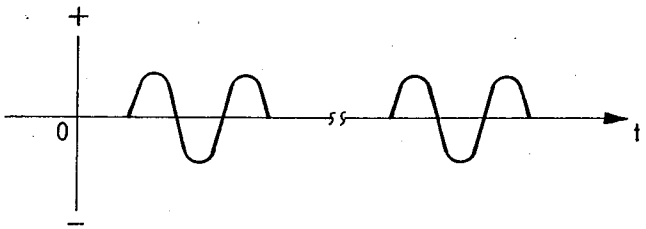
FIG. 8 is an idealized graphical representation of the output of the pick-up coil of the ignition system of FIG. 6.

As shown in FIG. 8, the magnet M (or magnets) which moves past the charge/trigger coil 102 with each revolution of the engine flywheel (not shown) is designed to induce a current flow characterized by a leading positive alternation, a succeeding negative alternation, and a trailing positive alternation as described more fully in U.S. Pat. No. 4,169,446, assigned in common herewith. As the permanent magnet M moves past the charge/trigger coil 102, the leading positive alternation generates a positive voltage potential with the resistor R1 providing desired loading and the diode D1 rectifying the charge output so that the CSI network 112 accepts a charge; this charge being of sufficient magnitude to produce a desired output pulse. The time-varying nature of the electrical energy applied during charging is affected by the impedance of those components in circuit with the CSI network 112 so that any magnetic field produced during the application of the charge energy will be desirably less than that needed to induce a pulse in the output coil inductor 114. The succeeding negative alternation reverses the current output of the coil 102 with the diode D1 preventing discharge of the now-charged CSI network 112. The diode D3 is effective to rectify the trigger output of the trigger portion of the coil TRIG as the magnet M sweeps by to provide a gate trigger current to the gate G of the silicon controlled rectifier SCR1 with the trigger point determined by the resistive divider R2 and R3. When the gate current of SCR1 reaches its trigger level, the SCR 1 goes into conduction to shunt the conductive strips together causing a transient discharge current flow which generates a rapidly changing magnetic field, the magnetic lines of flux of which are concentrated by the core 116 and cut through the turns of the output coil inductor 114 to generate the desired voltage pulse at the gap G. Because of the LCR nature of network, oscillations or 'ringing' can occur with these oscillations clamped by the diode D2. On the next trailing positive alternation, the CSI network 112 is again charged as described above and holds that charge until the flywheel and its magnet M passes the generator/trigger coil 102 on the next rotation of the flywheel. At this point, a leading positive alternation will be available to provide additional energy to charge the CSI network 112, for example, were the CSI network was not fully charged by the trailing positive alternation of the preceding set of alternations. In this manner, the circuit operates periodically to provide pulses to the spark gap.

The ignition system shown in FIGS. 6 and 7 is well suited for single cylinder engines. As can be appreciated, pulse-forming ignition systems utilizing battery power can be provided in multi-cylinder engines, such as motor vehicle engines. An ignition pulse-forming system can be mounted on or connected to each spark plug with the application of charge energy and discharge triggering controlled by a central controller, such as a central electronic fuel-injection controller.

In addition to the ignition system applications described above, current sheet inductor pulse-forming networks and systems can be utilized in radar pulse formation and pyrotechnic ignition, for example.

As can be appreciated by those skilled in the art, the present invention provides a current sheet inductor network and pulse generating systems that can accept an electrical charge and retain that charge in a capacitive manner and also produce a magnetic field upon rapid discharge of the so-retained energy.

As can be appreciated, various changes and modifications may be made to the present invention without departing from the spirit and scope of the invention as defined in the appended claims and their legal equivalent.

I claim:

1. An electrical energy storage and transfer device comprising:

a current sheet inductor network means having at least first and second conductive sheet means separated by and insulated from one another by a dielectric means to provide capacitive and inductive coupling therebetween; said current sheet inductor network means for receiving an electrical charge in response to electron flow caused in said sheet means, for storing the so-received electrical charge, and for discharging said electrical charge through electron flow in said sheet means, the electron flow at least during discharge sufficient to produce a consequent magnetic field; and circuit means connected to said first and second conductive sheet means of said current sheet inductor network means for (a) applying a unidirectional current electrical charge to said current sheet inductor means by causing an electron flow in said conductive sheets, (b) storing said electric charge for a predetermined time period, and (c) discharging said electric charge by substantially shunting said so-charged first and second conductive sheets to cause an electron flow sufficient to produce a magnetic field that induces an output electric pulse in an electrical energy output means;

an inductor means in an inductive coupled relationship with said current sheet inductor network means to be cut by the lines of magnetic flux during production of a consequent magnetic field to thereby cause an electron flow in said inductor means wherein said inductor means comprises at least one wire of selected length to form an output coil wound to define an internal opening of selected diameter;

said output coil including a series of N discrete serially connected subcoils and a pair of terminals connected to the opposite ends of said output coil wherein the first and Nth subcoils have less windings than the subcoils intermediate the first and Nth subcoils such that the lower number of windings are present where fewer lines of force of said consequent magnetic field are present and the greater number of windings are present where a greater number of the lines of force of said consequent magnetic field are concentrated to thereby produce said electron flow through said terminals of said output coil.

2. The electrical energy storage and transfer device claimed in claim 1 wherein said current sheet inductor network means comprises:

at least first and second elongated conductive strips wound in a coil with at least first and second dielectric strips separating and insulating said first and second elongated conductive strips from one another.

3. The electrical energy storage and transfer device claimed in claim 2 further comprising:

at least a first terminal lead connected to said first strip and at least a second terminal lead connected to said second strip, said leads for connection to a source of electrical energy to cause electron flow in said strips.

4. The electrical energy storage and transfer device claimed in claim 3 wherein at least one of said first and second terminal leads is connected to its respective strip at a point intermediate the ends thereof.

5. The electrical energy transfer and storage device claimed in claim 2 wherein said coil is so wound to define an internal opening of selected diameter.

6. The electrical energy storage and transfer device claimed in claim 1 further comprising:

a core of selected permeability positioned within said internal opening of said output coil.

7. An electric pulse-forming ignition system, comprising:

a current sheet inductor network means having at least first and second conductive sheet means separated and insulated from one another by a dielectric means, said current sheet inductor network means receiving and storing an electrical charge in response to an electron flow in said conductive sheet means and discharging the so-received and stored electric charge in response to an electron flow caused in said conductive sheet means, the electron flow at least during discharge sufficient to produce a consequent magnetic field;

electrical energy output means defined by an inductor means positioned relative to said current sheet inductor network means to be cut by the lines of magnetic flux during production of said consequent magnetic field; said electrical energy output means having terminals for connection to an output pulse utilizing means;

circuit means connected to said first and second conductive sheet means of said current sheet inductor network means for (a) applying a unidirectional electrical charge to said current sheet inductor means by causing an electron flow in said conductive sheets, (b) storing said electric charge for a predetermined time period, and (c) discharging said electric charge by substantially shunting said so-charged first and second conductive sheets to cause an electron flow sufficient to produce a magnetic field that induces an output electric pulse in said electrical energy output means; and said inductor means comprising a wire coil wound to define an internal opening of selected diameter, said wire coil including a series of N discrete serially connected subcoils and a pair of terminals connected to the opposite ends of said wire coil wherein the first and Nth subcoils have less windings than the subcoils intermediate the first and Nth subcoils such that the lower number of windings are present where fewer lines of force of said consequent magnetic field are present and the greater number of windings are present where a greater number of the lines of force of said consequent magnetic field are concentrated to thereby produce said output electric pulse across said terminals of said wire coil.

8. The electric pulse-forming ignition system claimed in claim 7 wherein said current sheet inductor network means comprises:

at least first and second elongated conductive strips wound in a coil with first and second dielectric sheets separating and insulating said first and second elongated conductive strips from one another.

9. The electric pulse-forming ignition system claimed in claim 8 further comprising:

a first terminal lead connected to said first conductive strip and a second terminal lead connected to said second conductive strip, said leads for connection to said circuit means.

10. The electric pulse-forming ignition system claimed in claim 9 wherein at least one of said first and second terminal leads is connected to its respective conductive strip at a point intermediate the ends thereof.

11. The electric pulse-forming ignition system claimed in claim 8 wherein said coil is so wound to define an internal opening of select diameter.

12. The electric pulse-forming ignition system claimed in claim 7 wherein said inductor means comprises:

at least one wire of selected length wound to form an output coil.

13. The electric pulse-forming ignition system claimed in claim 7 further comprising:

a core of selected permeability positioned within said internal opening of said wire coil.

* * * * *